United States Patent [19]

Craig

[11] 4,205,850

[45] Jun. 3, 1980

[54] PARTNER PUZZLE GAME

[76] Inventor: Timothy J. Craig, 6945 DeCelis, Van Nuys, Calif. 91406

[21] Appl. No.: 5,098

[22] Filed: Jan. 22, 1979

[51] Int. Cl.[2] ..... A63F 9/12

[52] U.S. Cl. ..... 273/157 R; 35/73; 273/241

[58] Field of Search ..... 273/157 R, 157 A, 241, 273/239; 35/73

[56] References Cited

U.S. PATENT DOCUMENTS

| | | | |
|---|---|---|---|
| 3,082,004 | 3/1963 | Friedman | 273/241 X |
| 3,281,966 | 11/1966 | Johnson | 273/157 R X |
| 3,570,144 | 3/1971 | McNutt | 273/157 R X |
| 3,588,115 | 6/1971 | Nichols | 273/157 A X |
| 3,674,272 | 7/1972 | Wszalek | 273/241 X |
| 3,799,548 | 3/1974 | Lemkin | 273/241 X |
| 3,824,712 | 7/1974 | Powell | 35/73 |

*Primary Examiner*—Anton O. Oechsle

*Attorney, Agent, or Firm*—Edward C. Walsh; Albert M. Herzig

[57] ABSTRACT

A game for two people, either adults or children, calculated to teach social and cognitive skills. A playing board is provided which is upright to allow players to play or manipulate from opposite sides. The board may be layers or laminations with corresponding or registering shallow recesses on each side. The shape of each recess may be that of a human figure, such as a cartoon figure or the like. Playing pieces are provided on each side, which are pieces corresponding to the pieces of a jig-saw puzzle, which can be fitted into the recesses to complete the figure on each side. Apertures are provided through the board and securement means are provided on respective playing pieces so that corresponding pieces on each side of the board when properly positioned in recesses can be held together by the securing means, which may be magnets, VELCRO or other means. Cooperative skills on the part of the players is required for complete and correct assembly or positioning of the parts on each side of the board.

13 Claims, 10 Drawing Figures

FIG. 1
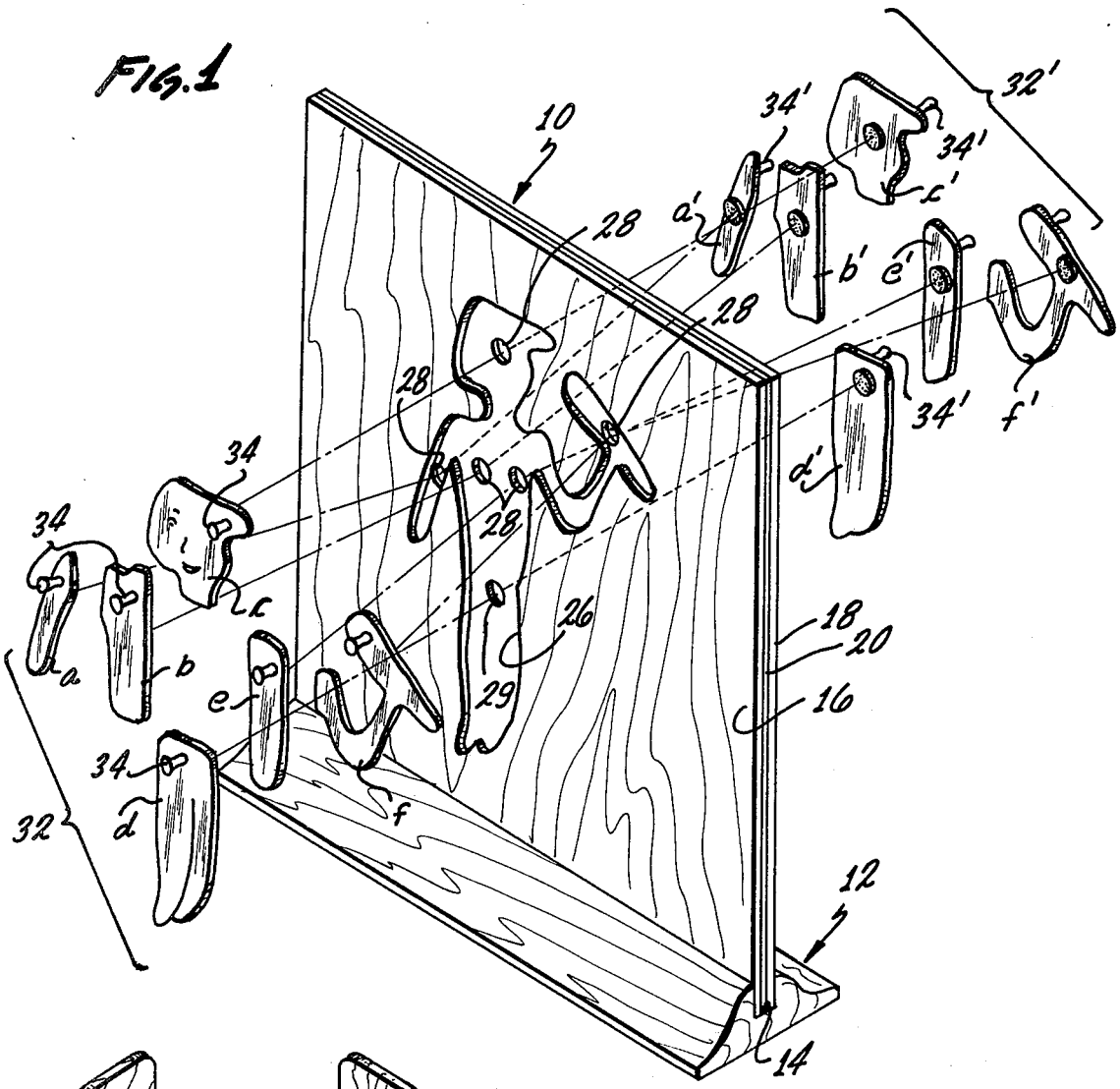
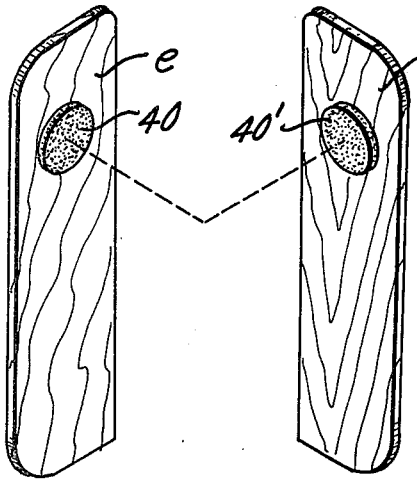
FIG. 2
FIG. 3
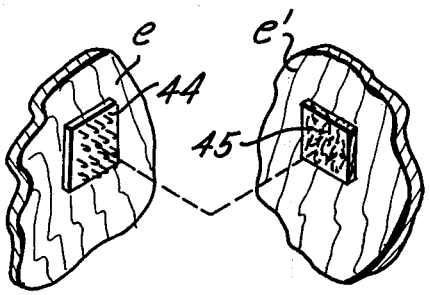

FIG. 7
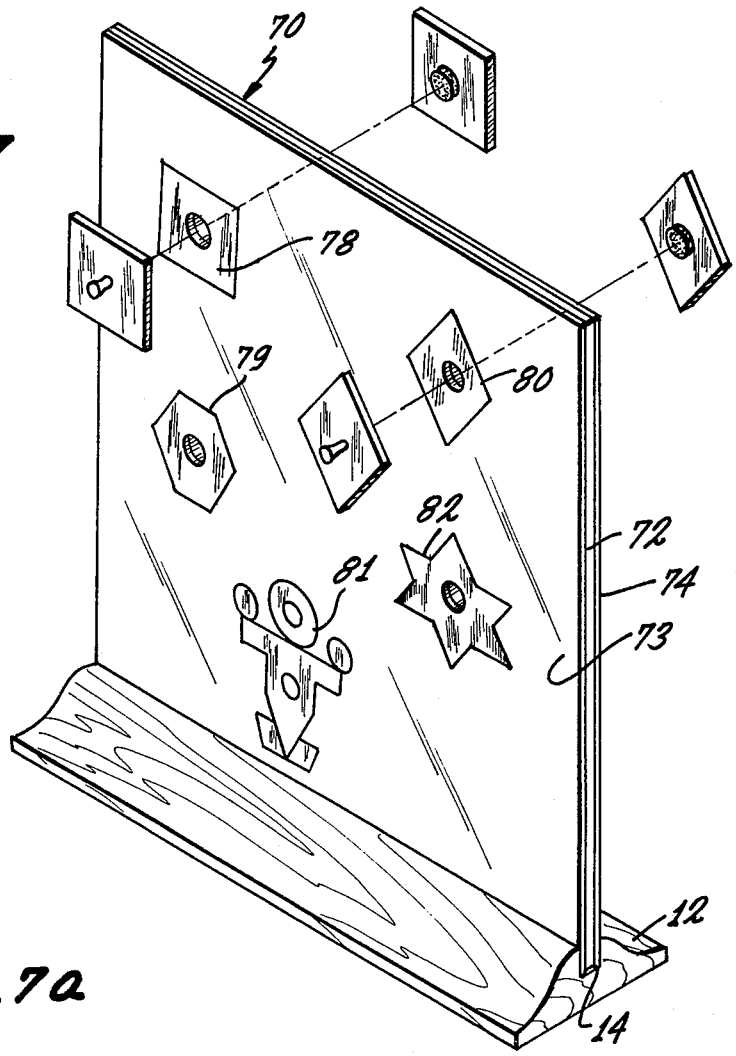
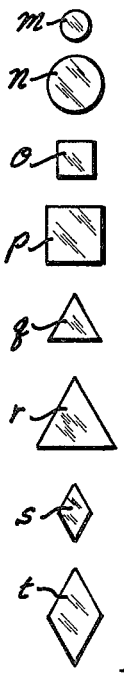
FIG. 7a
FIG. 8
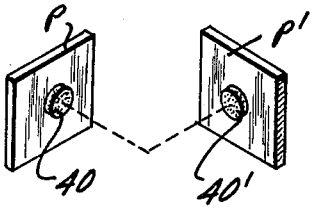
FIG. 9
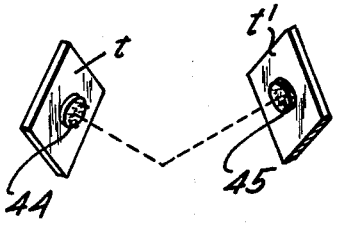

PARTNER PUZZLE GAME

BACKGROUND OF THE INVENTION

1. Field of the Invention

The field of the invention broadly is that of games, particularly puzzle games adapted for use either by adults or children. More particularly, the field of the invention is a particularized puzzle game, adapted for play by two people, wherein the characteristic is embodied that cooperative and cognitive skills on the part of the players is developed and is required for successful solution of the puzzle.

2. Description of the Prior Art

Various different types of games, puzzles and puzzle games are known in the prior art. The prior art includes U.S. Pat. Nos. 2,659,163; 2,948,535; and 3,280,499 which deal with games or games that may involve a puzzle characteristic. The known prior art however is lacking in teaching of a type of game or puzzle having the characteristics of the herein invention and particularly, the built in characteristic that the game or puzzle has the capability of teaching and/or requiring the application of cooperation in the sense of social or cognitive skills.

SUMMARY OF THE INVENTION

A preferred exemplary form of the invention, is identified briefly in the abstract.

In an exemplary form of the invention, the playing board is on a support to hold it vertically and it is preferably of laminated or layered construction. Each of the outer sheets has a cutout or shallow recess in it, the recesses overlying each other and being of a particular shape, such as that of a human figure or cartoon character or the like.

Corresponding individual pieces are provided for use on each side of the board which can be fitted into the recess on that side in the manner of the pieces of a jigsaw puzzle, so that when properly fitted the complete figure is completed or reproduced. Individual pieces are held in position only when the piece is properly positioned and its corresponding piece is properly positioned on the opposite side of the board, the two pieces being then held together by way of securement means operating through apertures in the middle layer or lamination of the board. The securing means may be magnets or VELCRO or the like.

The invention may be practiced in alternative modified forms. In one alternative form, the board may be a single piece or lamination with recesses or depressions formed in opposite sides of the board. In other alternative forms of the invention, the figure or images may be inscribed or otherwise provided directly on the surface of the board which may be of transparent plastic. Alternatively, the figures or images may be inscribed or provided on thin sheets of material such as plastic which are placed against the primary board which has greater thickness so that other thin sheets having different patterns of images or figures can readily be substituted. Edge guides may be provided so that the sheets having the images thereon may be split into position relative to the primary board.

In the light of the foregoing, the primary object of the invention is to provide a unique and novel puzzle game of a type adapted for play by two players and having the characteristic that to complete or solve the puzzle, cooperative skill on the part of the two players is required.

A further object is to realize a puzzle game as in the foregoing object in the form of a playing board arranged for play by players on opposite sides of the board, the board having means in the form of recesses to receive individual parts which when properly placed and positioned complete an image or figure on that side of the board, corresponding individual pieces on opposite sides being held together.

Further objects and additional advantages of the invention will become apparent from the following detailed description and annexed drawings.

BRIEF DESCRIPTION OF THE DRAWINGS

FIG. 1 is an isometric or pictorial illustration of a preferred form of the invention;

FIG. 2 is a detail view illustrating corresponding individual parts being held together magnetically;

FIG. 3 is a detail view illustrating corresponding individual parts being held together by way of VELCRO securement;

FIG. 7 is an isometric or pictorial representation of another form of the invention.

Figure 4:
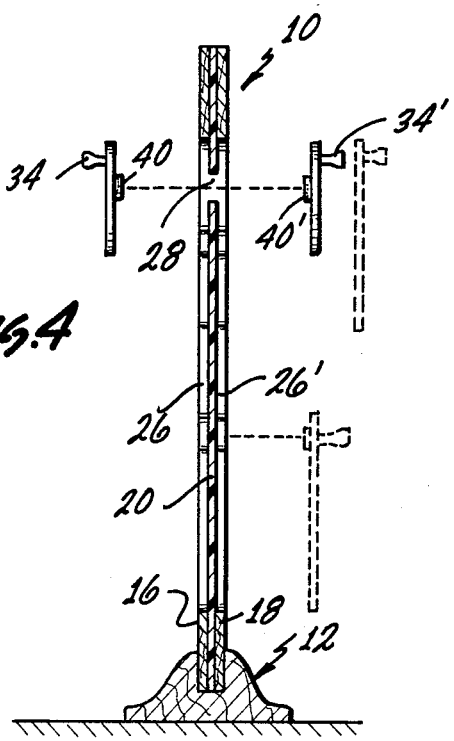
FIG. 4 is a sectional view through the playing board of FIG. 1 illustrating the manner of positioning and holding individual pieces.

FIG. *7a* is a top plan view of various pieces usable in the FIG. 7 form of the invention.

FIG. 8 is a detail view illustrating corresponding individual parts utilized in the form of the invention of FIG. 7 and being held together magnetically.

FIG. 9 is a detail view illustrating corresponding individual parts used in the form of the invention of FIG. 7 being held together by way of VELCRO securement.

DESCRIPTION OF THE PREFERRED FORM OF THE INVENTION AND BEST MODE OF PRACTICE

FIGS. 1–5 show a preferred form of the invention. In these figures numeral 10 designates the playing board which is of layered or laminated construction. A base 12 is provided which may be made of any suitable material, such as wood or the like, the base forming a foot or stand for the board. The base has slot 14 in it which receives the board.

As shown, the board is formed of three layers or laminations, the outer layers being identified by the numerals 16 and 18, these being sheets of thin wood, or plywood, or the like. In between these layers is a thin layer of transparent plastic or plexiglass as identified at 20. The board as shown is rectangular, although it might have other shapes.

As may be seen in FIG. 1, formed in the layer 16 is a shallow recess 26 which may have various shapes, the shape as shown being that of a figure, which might be a cartoon character. A corresponding recess of the same shape is provided in the other sheet 18, the two recesses, that is the shapes registering, that is overlying each other. A corresponding recess is not formed in the intermediate layer or sheet 20. Provided in this sheet are a plurality of apertures or openings, such as designated at 28, FIG. 1 at different positions relative to the recesses.

Referring to FIG. 1, a group of flat playing pieces is provided as identified by the numeral 32 of different shapes, the pieces having a thickness equal to or greater than the depth of the recess 26. The pieces are like the pieces of a jig-saw puzzle. They can be fitted into or positioned at appropriate positions in the recess 26 so that when properly fitted in, the complete figure as represented by the recess 26 is reproduced. The pieces may of course be painted or otherwise decorated so that when the positioning and inter fitting is complete, a pleasingly appearing figure or other image results. In FIG. 1, the various pieces are individually identified by the letters a, b, c, d, e, and f. On one side that is on the outside of each piece there is provided an extending handle or grip as identified at 34 in FIGS. 1, 4 and 5.

For use on the opposite side of the board there is provided a similar corresponding group of pieces identified by the numeral 32', these individual pieces having the same shape so that they can be similarly fitted into the corresponding recess 26' in the sheet 18. Each of these pieces is similarly provided with a stem, grip or handle as identified at 34' in FIGS. 4 and 5. These pieces are individually identified by the characters a', b', c', d', e' and f'.

FIG. 2 illustrates a preferred manner of securing corresponding pieces together when they are properly positioned in recesses on opposite sides of the board. FIG. 2 shows the corresponding pieces e and e'. On the inside of the piece e is a small alnico magnet 40 and on the inside of the piece e' is a corresponding small alnico magnet 40'; the magnets being positioned such that when the pieces are properly placed in their respective recesses the magnets come into contact so as to hold the pieces in position, the magnets extending through an aperture in the middle plastic layer, such as the aperture 29 in FIG. 1.

FIG. 3 shows another way of securing corresponding pieces together. On the inside of the piece e instead of a magnet there is a small piece of VELCRO material as designated at 44 and on the piece e' in a corresponding position is another piece of VELCRO material as designated at 45. VELCRO is a well known commercial product useful for attaching things together. It comprises two pieces of fabric as represented by the items 44 and 45, one piece having fabric as represented by the items 44 and 45, one piece having fabric loops and the other piece having elements which will detachably engage with the loops when the pieces are pressed together. The VELCRO pieces 44 and 45 would detachably secure together through one of the apertures in the plastic lamination 20.

Figure 6:
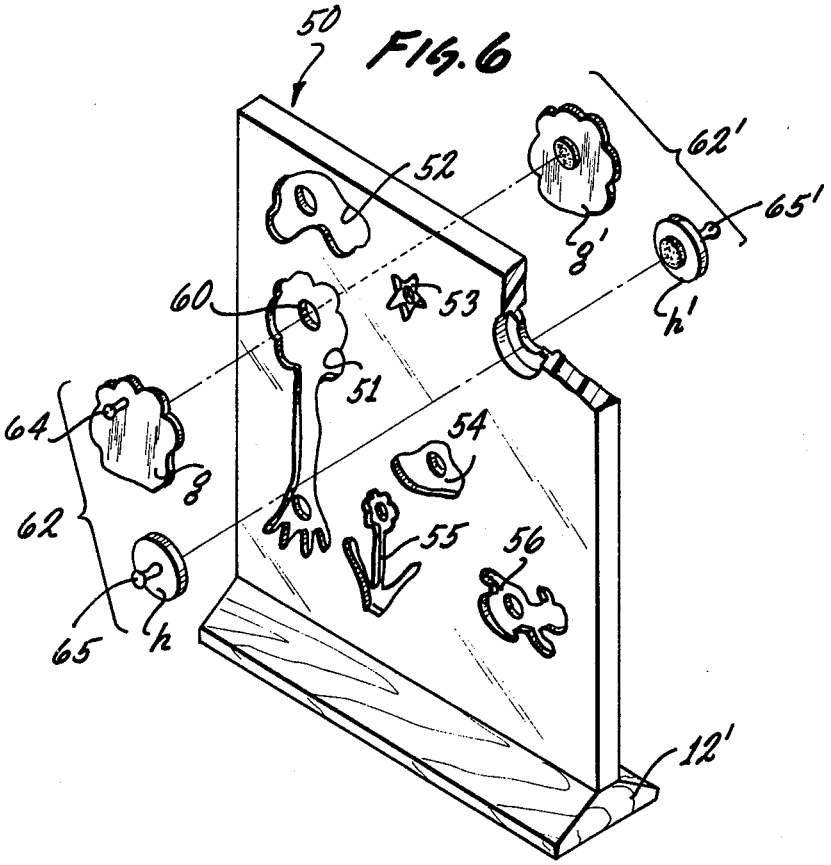
FIG. 6 is an isometric or pictorial view of a modified form of the invention.

FIG. 6 illustrates a modified form of the invention having a board 50 which is made of plastic rather than being laminated. The base is shown at 12' being constructed to similarly support the board 50.

In this form of the invention, the board 50 is shown as having shallow depressions or recesses formed in one side of different shapes as shown and as designated by the numerals 51, 52, 53, 54, 55, and 56. Similar corresponding depressions are formed on the opposite side of the board, registering with or aligned with the depressions as just described, the depth of the depressions being such as to provide bottom surfaces, that is the depths of the depressions on opposite sides do not equal the total thickness of the board. As in the previous embodiment, provided at the position of each depression are apertures extending through the board, such as designated at 60 in FIG. 6.

A group of pieces is provided as in the previous embodiment as designated at 62, two pieces being shown and identified by the letters g and h of a shape to fit into corresponding recesses in the board 50. As similar groups of pieces 62' is provided for the player on the opposite side of the board, including pieces g' and h'. The pieces have extending stems or handles as designated at 64, and 65, and at 65' for this piece on the opposite side of the board. The manner of play or utilization with the form of the invention shown in FIG. 6 is the same or similar to that of the form of the invention, FIGS. 1–5.

Figure 5:
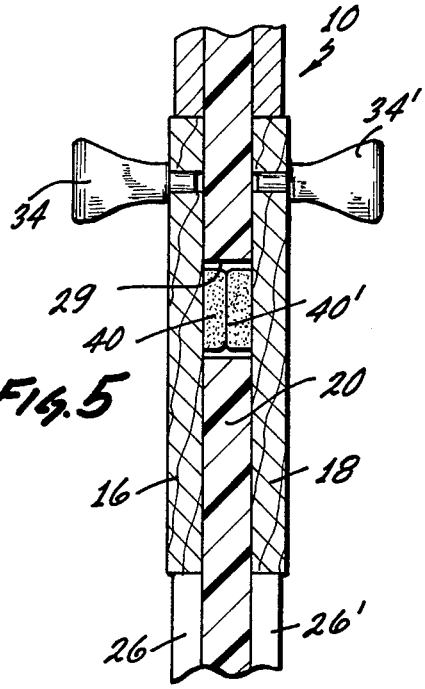
FIG. 5 is an englarged sectional view illustrating corresponding pieces held in recesses in the board.

The manner of play of the puzzle game or the manner of utilization will be readily apparent to those skilled in the art from the foregoing description as further illustrated in FIGS. 4 and 5. The player on each side seeks to correctly position each piece into the respective recess on that side of the board. When players on opposite sides have corresponding pieces correctly positioned, the pieces will be held together by the securement means as illustrated in FIGS. 2 and 3. Thus, the players must cooperate and in this respect social and cognitive skills are developed and are required to ultimately solve the puzzle by way of having all pieces on each side properly positioned to complete the figure on that side with the pieces held together in the manner described. The stems or grips on the pieces make it easy for players to manipulate them to position them and to get them into the proper place in respective recesses.

FIGS. 7, 8, and 9 show another modified form of the invention. While at the present time, it is considered that FIGS. 1–5 represent the preferred form and mode of practicing the invention, it is possible that in the future, the forms shown in FIGS. 7–9 might be considered the preferred form.

In FIGS. 7–9, numeral 70 illustrates the board. It includes an intermediate transparent piece having a thickness as shown which may be transparent plastic, such as Plexiglass. On each side of the layer 72 is a thin transparent plastic sheet which may be Mylar, these sheets being designated by the numerals 73 and 74. All these sheets can be held in a slot 14 in a base or foot member 12, like that of FIG. 1. Alternatively or optionally, a frame can be provided around the member 72, providing slots or grooves to allow the sheets 73 and 74 to be slid in and out of position.

Inscribed on the surface of the sheet 73 and similarly on the sheet 74 are figures or images as designated at 78, 79, 80, 81, and 82. As shown, these images are geometrical shapes although they could of course be any other type of figure or image. The images on the sheet 74 correspond to and are opposite to the images on the sheet 73. Alternatively, these images could be inscribed or painted on or otherwise depicted directly on the surface of the sheet or member 72. By having them on the sheets 73 and 74 it becomes possible to substitute other sheets with different patterns of images.

FIG. 7*a* illustrates a representation of playing pieces which in this form of the invention, preferably are geometric shapes as shown, including circular pieces, squares pieces, triangular pieces and diamond shaped pieces. The playing pieces are identified by the letters m,n,o,p,q,r,s, and t. Preferably, the playing pieces are simply made of thin plastic. The playing pieces can be fitted against the geometric shapes or figures on the Mylar sheets, like the pieces of a jig saw puzzle so that the pieces fit together and form the pattern of the image or figure and cover it. The pieces can be held to the surface in the same manner as in the previous embodiments, that is either by way of magnets as illustrated in FIG. 8 or by way of VELCRO material as illustrated in FIG. 9.

If magnets are used to hold the pieces in position, that is corresponding pieces opposite to each other on opposite sides of the board 70, it is not necessary to have holes in the board and Mylar sheets. In FIG. 7 holes or appertures are shown which would accomodate the pieces of VELCRO material.

From the foregoing, those skilled in the art will readily understand the nature and construction of the invention and the manner in which the objects is outlined in the foregoing are realized.

The foregoing disclosure is representative of preferred forms of the invention and is to be interpreted in an illustrative rather than a limiting sense, the invention to be accorded the full scope of the claims appended hereto.

What is claimed is:

1. As an article of manufacture, a puzzle game including in combination, a playing board, means on each side of the board defining the outline of at least one particular figure or image, the images on opposite sides registering with each other, a group of playing pieces of irregular shapes for use on one side of the board, the pieces being contoured so that they can be fitted to correspond to an image on that side of the board, a set of pieces of corresponding shape for use on the opposite side of the board which can similarly be fitted so as to correspond to the registering image on the other side of the board, and means whereby individual corresponding playing pieces on opposite sides of the board can be secured and held in position when the corresponding respective pieces on opposite sides have been properly positioned.

2. An article as in claim 1 wherein the board is provided with apertures, individual corresponding pieces being provided with means whereby said individual corresponding can be secured together by way of the said apertures.

3. An article as in claim 1 wherein the said figure or image on each side of the board is provided by way of shallow depressions in the board on each side, the total depth of the depressions on each side being less than the thickness of the board.

4. An article as in claim 3 wherein apertures are formed in the board within the areas of the depressions for purposes of securing together individual respective playing pieces on opposite side of the board.

5. An article as in claim 1 wherein the board is of laminated construction including two outer laminations each of which is provided with a depression corresponding to the shape or contour or of the figure or image, and an intermediate lamination lying between the two outer laminations.

6. An article as in claim 1 wherein the respective playing pieces are provided with magnets carried by individual pieces which provide for securing respective individual pieces together.

7. An article as in claim 2 wherein individual pieces are provided with pieces of VELCRO material and whereby individual respective pieces can be secured together by way of the apertures in the board.

8. An article as in claim 1 including a plurality of playing pieces for each side of the board, contoured relatively so that they can be fitted together to produce and correspond to the image on the respective side of the board.

9. An article as in claim 8 wherein the said figure or image on each side of the board is provided by way of shallow depressions in the board on each side, the playing pieces when fitted together fitting into the depression.

10. An article as in claim 9 wherein respective playing pieces on opposite sides of the board are provided with magnets for securing them to each other.

11. An article as in claim 10 wherein the board is provided with apertures to accomodate by securement by way of the magnets.

12. An article as in claim 11 wherein the playing board includes a first member, and additional members on each side of the first member, the figures or images being inscribed on the additional members.

13. An article as in claim 12 wherein the first member and the additional members are transparent, the additional members being made of relatively thin transparent plastic, whereby members having different images thereon can be substituted for the additional members.

* * * * *